US009630733B2

(12) United States Patent
Benedetti

(10) Patent No.: US 9,630,733 B2
(45) Date of Patent: Apr. 25, 2017

(54) PLANT FOR MANUAL PACKAGING OF PRODUCTS, IN PARTICULAR FRUIT AND VEGETABLE PRODUCTS

(75) Inventor: Luca Benedetti, Savarna (IT)

(73) Assignee: UNITEC S.P.A., Lugo (RA) (IT)

( * ) Notice: Subject to any disclaimer, the term of this patent is extended or adjusted under 35 U.S.C. 154(b) by 590 days.

(21) Appl. No.: 14/237,083

(22) PCT Filed: Sep. 14, 2012

(86) PCT No.: PCT/EP2012/068140
§ 371 (c)(1),
(2), (4) Date: Feb. 4, 2014

(87) PCT Pub. No.: WO2013/041464
PCT Pub. Date: Mar. 28, 2013

(65) Prior Publication Data

US 2014/0190123 A1 Jul. 10, 2014

(30) Foreign Application Priority Data

Sep. 23, 2011 (IT) ..... PN20110026 U

(51) Int. Cl.
*B65B 25/04* (2006.01)
*B65B 67/02* (2006.01)

(52) U.S. Cl.
CPC ..... *B65B 67/02* (2013.01); *B65B 25/046* (2013.01)

(58) Field of Classification Search
CPC ..... B65B 5/10; B65B 25/04; B65B 25/046; B65B 67/02
USPC ..... 53/251, 390, 391
See application file for complete search history.

(56) References Cited

U.S. PATENT DOCUMENTS 1,395,727 A * 11/1921 Odermatt ..... B65B 67/02 53/391
1,558,014 A * 10/1925 Jaenicke ..... B65G 37/00 193/35 MD
RE16,392 E * 7/1926 Wilhelm ..... B07B 13/00 209/702

(Continued)

FOREIGN PATENT DOCUMENTS

BE 1003960 A7 * 7/1992 ..... B65B 67/02
FR 2679201 A1 * 1/1993 ..... B65B 19/34

(Continued)

*Primary Examiner* — Stephen F Gerrity
(74) *Attorney, Agent, or Firm* — Birch, Stewart, Kolasch & Birch, LLP

(57) ABSTRACT

A plant for manual packaging of crates with fruit and vegetable products includes a first mobile horizontal belt conveyor on which products are placed and a second mobile conveyor on which are placed a plurality of crates. The two conveyors are arranged on parallel horizontal planes. The upper surface of the second conveyor is arranged at least partially overlying the position of the first conveyor. A return conveyor is arranged on the same horizontal plane as the first mobile conveyor, and moving in a direction opposite to the first conveyor. A third mobile conveyor may be provided, similar to the first conveyor, moving in the same direction as the first conveyor and arranged, with respect to a median vertical plane of the return conveyor, in a position opposite and preferably symmetrical to said first conveyor.

18 Claims, 6 Drawing Sheets

(56) References Cited

U.S. PATENT DOCUMENTS 2,108,869 A * 2/1938 Sandmeyer ..... B65B 25/04 198/580
2,317,374 A * 4/1943 Goodwin ..... B65B 67/02 221/259
2,521,998 A * 9/1950 Rottier ..... B65B 25/046 141/234
2,580,599 A * 1/1952 Rogers ..... B65B 25/04 198/404
2,969,633 A 1/1961 Archer
3,161,004 A * 12/1964 Muzinich ..... B65B 67/02 198/560
3,241,650 A * 3/1966 Horton ..... B65B 67/02 198/346
4,306,633 A * 12/1981 Langen et al. ..... B65B 43/42 186/66
4,375,855 A * 3/1983 Floyd ..... B65B 25/04 198/311
4,401,020 A * 8/1983 Brux ..... B65B 13/022 100/6
4,506,492 A * 3/1985 Boyd ..... B65B 25/046 53/245
4,617,778 A * 10/1986 Blackman ..... B65B 43/54 53/252
5,325,653 A * 7/1994 Boyd ..... B65B 25/046 141/128
5,743,068 A * 4/1998 Madariaga ..... B65B 5/08 53/247
2011/0036061 A1 2/2011 De Vos

FOREIGN PATENT DOCUMENTS

FR 2686314 A1 * 7/1993 ..... B65B 25/046
FR 2 833 867 A1 6/2003
GB 122912 A * 2/1919 ..... B65B 67/02
WO WO 02/20353 A1 3/2002
WO WO 2012157005 A1 * 11/2012 ..... B65B 5/10

* cited by examiner

PLANT FOR MANUAL PACKAGING OF PRODUCTS, IN PARTICULAR FRUIT AND VEGETABLE PRODUCTS

The present invention concerns an improved plant for manually arranging a plurality of products, in particular but not exclusively fruit and vegetable products, in respective crates, in a manner such as to fill the crates in an orderly, precise and gentle manner in order to ready them for use in the final distribution network.

It is well known that, in the field of marketing of fruit and vegetable products, in particular fruit, it is a common practice to use rather wide crates in which is preferably placed a semi-rigid sheet shaped in such a manner as to present a plurality of upwardly-facing alveoli, naturally appropriately sized for the products they are intended to contain.

In said alveoli are inserted, normally in a single layer, the relative products, which are thus suitably protected against impacts, crushing, and in any case against improper handling.

In addition to this, the fact that the products are all plainly visible from above, that is from the point of view of the potential customer, gives them a more attractive appearance.

This methodology is used principally to enhance the value of products of high quality, which naturally would not be increased if the same products were piled in bulk, and thus often damaged, in normal containers, such as deep crates or bins.

Different methods are known and used to implement this type of packaging.

U.S. Pat. No. 3,685,624 proposes a mode of packaging fruit and vegetable products that also uses, among other means, a plurality of suction cups that are lowered and applied onto each product to arrange; the "grip" of such suction cups on the relative product is obtained by applying a vacuum inside said suction cups, so that the product is drawn up and carried by its suction cup to the desired position, where it is released.

This procedure has however some drawbacks:

- firstly, it is considerably costly, as it requires a suction and release system, and naturally all the flexible ducts to arrange the various suction cups above the various products; it is also necessary to provide various adjusting and control devices to recognize the different products, to move the suction cups in the proper position, to adjust the various necessary pneumatic valves;
- in addition, there is no guarantee that the suction cups manage to effectively hold the relative products, due to the porosity of the products and to the normal unevenness of their surfaces; thus, it is necessary to provide for manual assistance given by operators dedicated to the task, but naturally this would counter the advantages of this methodology because it implies a further increase of the overall costs;
- moreover, this method cannot provide for any control of visual type on the effective externally apparent quality of the products, that is, on the general appearance of the individual products, with the possibility that products of inferior quality or appearance will be packaged together with other products of better quality, with the result of compromising the high-quality appearance of all the products arranged in the same crate, including naturally the products that in fact offer and display the required quality.

To overcome such drawbacks, hand packaging work tables as shown in the enclosed FIG. 1 have been provided.

According to this solution, two "crate transfer conveyors" are provided, consisting of two parallel conveyors carrying the empty crates to be filled with the products.

Substantially, in front of said conveyors are shown, from the side, two corresponding rows of operators who, while standing on their feet, arrange the products into the crates before them; the operators collect said products form two respective "fruit storage conveyors" located below the respective "crate transfer conveyors".

Said "fruit storage conveyors" also consist of respective mobile conveyors that travel under the respective "crate transfer conveyors".

Between the two "fruit storage conveyors" are also arranged two "fruit recirculation conveyors" which receive those products which the operators have not yet been able to transfer and place in the respective crates.

In addition, between the two "crate transfer conveyors" is arranged, in the uppermost position, a "rejected product conveyor".

It can also be seen that the two "fruit storage conveyors" extend considerably in the direction in front of said operators, so that the operators can inevitably see only one part of the products held there, since a relatively high percentage of the products are not visible to the operator due to the fact that they are covered by the relative overlying "crate transfer conveyor".

This type of hand packaging work table is well known to operators in the field, and therefore a further detailed description of the same is considered unnecessary.

The solution illustrated here, although it is quite satisfactory from the point of view of making it possible to carry out an accurate packaging of each product in a respective alveolus of a selected crate, has however shown that it cannot avoid the following serious operating drawbacks:

- the operators cannot see all the products present on the relative "fruit storage conveyor" in front of them, since this conveyor is largely masked by the overlying and respective "crate transfer conveyor".

Therefore, in order to be able to also pick up these "hidden" products, the operator must be able to lean forward as necessary, so as to see them and pick them up properly.

Naturally, this requires the operator to almost continuously bend her back to lean forward, which in time causes her aches and pains, and logically requires frequent work breaks, with a consequent reduced efficiency of the whole process;

- it must also be considered that the same operators are forced to stand up at all times, so that they can lean forward sufficiently to be able to see the whole area of the "fruit storage conveyor"; clearly, this upright position, with continuous forward leaning movements, leads to fatigue and justified complaints, because as is well known the upright standing position, without the leg movements that are common when walking, results in well-known negative effects on the spine and on blood circulation;
- moreover, it can be seen that, in order to facilitate the work of the operator, the relative "crate transfer conveyor" is inclined toward her, so as to allow her to have a full view of the alveoli on the whole surface of the crates.

However, this forces the operator to lift her arms to approximately eye level or higher, in order to reach the higher alveoli, which logically are the farthest ones. This continuous movement of the wrist and arm joints results, in relatively short times, in a consequent systematic articular painfulness, leading in the more serious cases to a risk of arthrosis of the wrist and arm joints that can often force the operator to interrupt her work.

Lastly, it must also be considered that recent regulatory obligations require that certain manual operations and processes, carried out with raised arms, must comply with precise ergonomic principles, which are only briefly mentioned here, principles and requirements that the present hand packaging work tables do not meet.

It would therefore be desirable, and it is the main objective of the present invention, to realize a type of hand packaging work table, particularly for manually packaging fruit and vegetable products, such as to substantially eliminate the problems described and that naturally is completely in line with the most recent requirements in the field.

This objective is achieved by the type of hand packaging work table built according to the enclosed claims.

Characteristics and advantages of the invention will become evident from the description which follows, given by way of example and without limitations, with reference to the enclosed drawings, wherein.

Although the present invention refers generally to a hand packaging work table that can theoretically be positioned at different angles and orientations, it will however be evident that it can find the best and most typical embodiment when the hand packaging work table is set on a horizontal floor; thus the description should be read with particular reference to the drawings, and therefore the terms "over", "under", "above", "below", etc., that may be employed refer logically to this normal arrangement of the same hand packaging work table.

Figure 1:
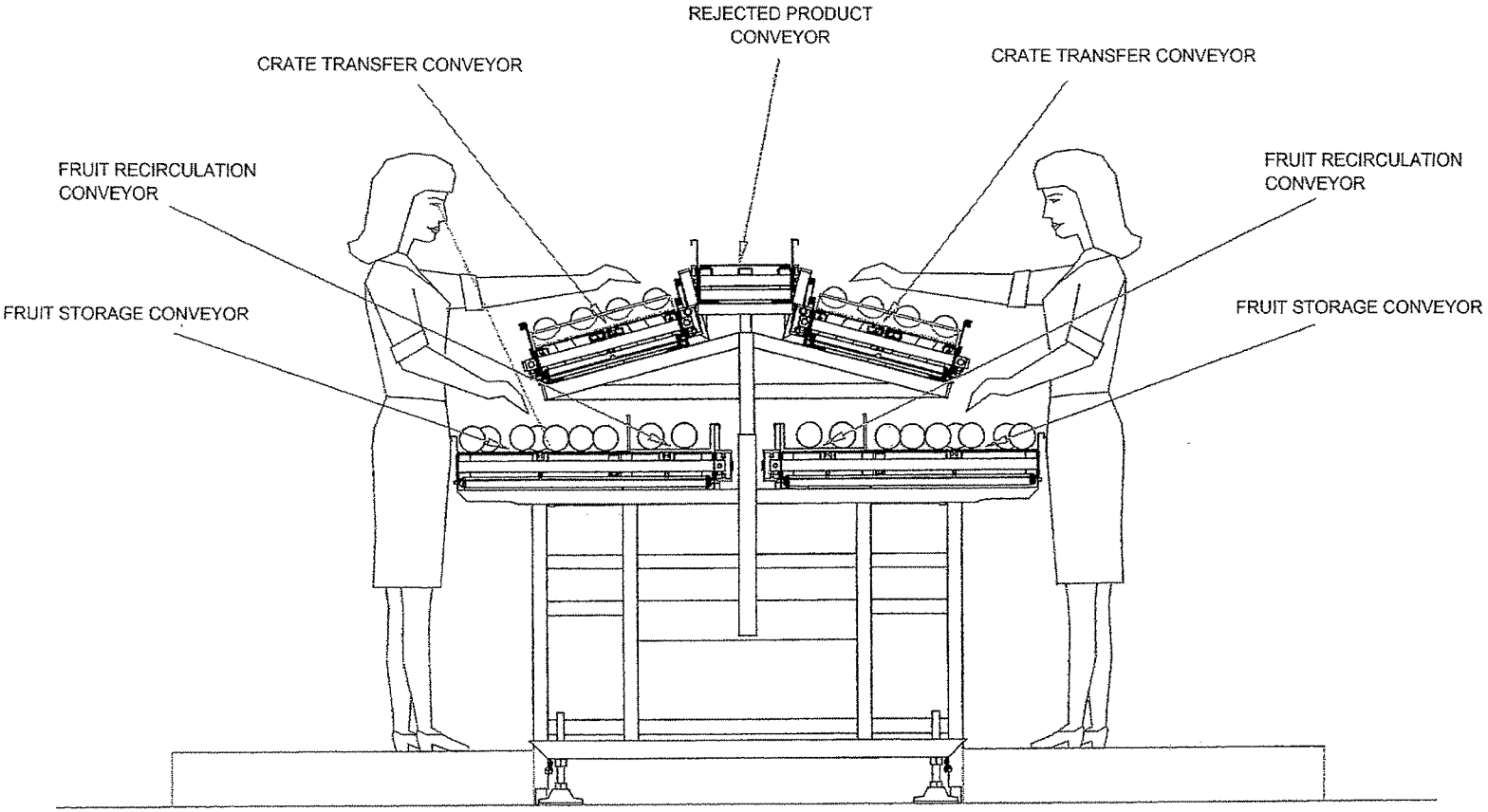
FIG. 1 CONVENTIONAL ART
FIG. 1 illustrates a vertical plane view of a hand packaging work table according to the known art, seen from the side and in simplified form, that is, from a point on a plane orthogonal to the direction of movement of the conveyors and on the plane symmetrical to the same hand packaging work table.

The present invention significantly modifies the known art of FIG. 1 through four basic modifications that are briefly summarized below:

1) The crate transfer conveyors are unified in a single conveyor, whose crates can then be filled by the operators from both sides. This substantial modification makes it possible to significantly reduce the width of the entire hand packaging work table, which offers the fundamental advantage of being able to decisively restrict both the width of the fruit storage conveyors and the width of the respective fruit recirculation conveyors.

This circumstance in particular makes it possible to achieve the fundamental result of observing directly, easily and without particularly tiresome body contortions practically all the products arranged on the fruit storage conveyors that are now geometrically below the single crate transfer conveyor.

A not secondary advantage of the invention is also the possibility of limiting as much as possible the space occupied by the lines and the equipment, with an evident general economic advantage.

2) The rejected product conveyor is eliminated from its original raised position but it is arranged between two distinct crate transfer conveyors, and is located in two different positions, alternative to each other:

- in the first case the rejected product conveyor is still in a raised position, but this time it is placed above the crate transfer conveyor (and not in an intermediate position between two distinct and separate crate transfer conveyors), and therefore in a more convenient and comfortable position for the operators;
- in the second case, the rejected product conveyor (that can also be used to transfer products of different quality, not similar to the quality of the products to be packaged at that moment) is placed in a lower position, below the other conveyors that carry the crates or the products to be packaged.

The above described new higher or lower positioning of the crate transfer conveyor is in fact made possible by the fact of combining the two crate transfer conveyors into a single one, which makes it possible to free a precious space above and between the fruit storage conveyors;

3) The two fruit recirculation conveyors are also combined into a single conveyor, that can then be supplied by both fruit storage conveyors, and this further contributes to narrowing the entire hand packaging work table;

4) As a consequence of the above described arrangements, the operators can now work while being seated, since the distance to which they have to stretch their arms is shorter, and the height to which they need to raise their hands is significantly lower, thanks to the fact that now the fruit storage conveyor and the crate transfer conveyor, being much narrower, can be brought significantly closer in height, without impairing their view by the operators.

Figure 2:
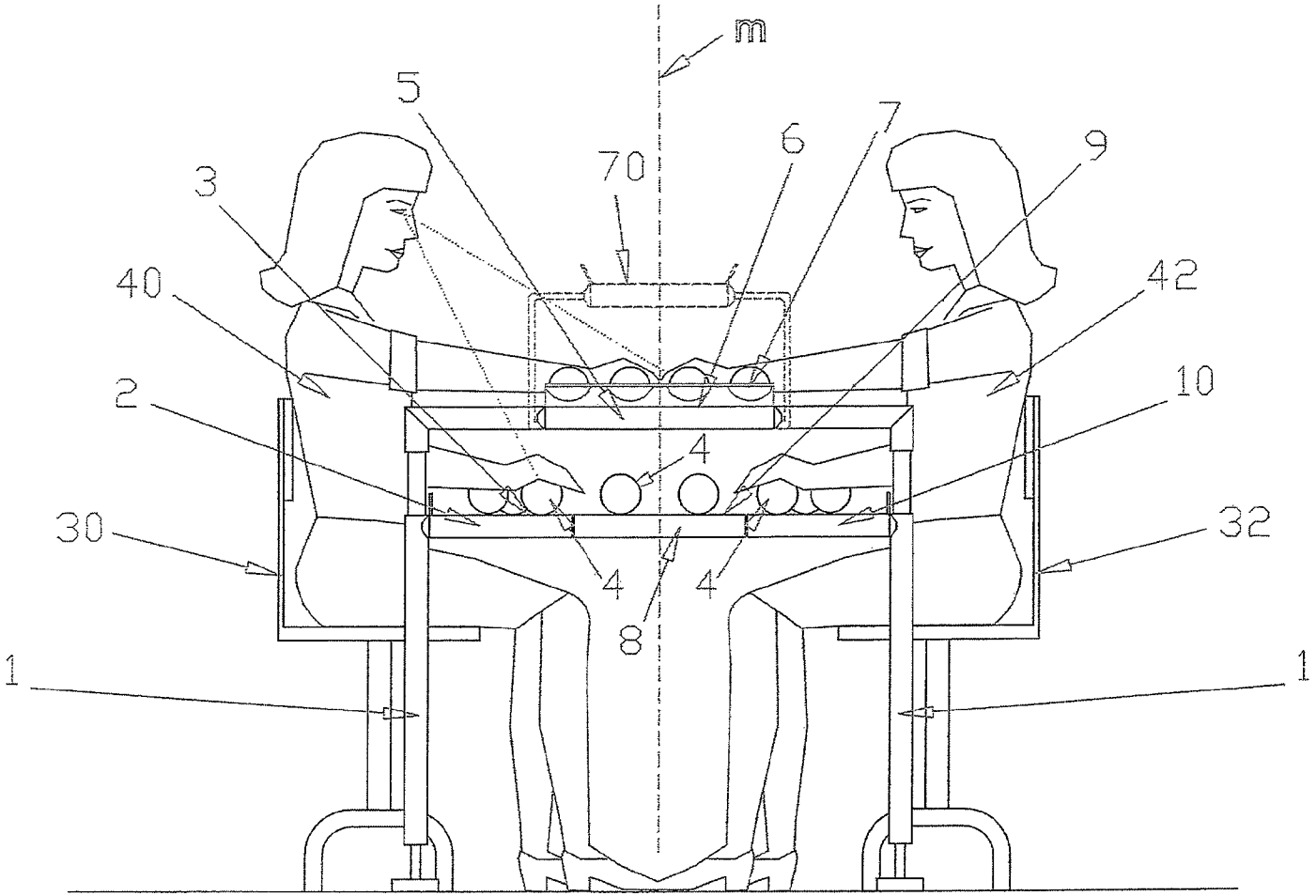
FIG. 2 is a completely identical view, but showing a hand packaging work table according to the invention.

Although the preferred and normal form of a hand packaging work table according to the invention is the one that includes two separate fruit storage conveyors, attended by two rows of operators seated face to face, as is shown in FIG. 2, the invention also applies in the more simplified case in which the hand packaging work table is without one of the two fruit storage conveyors and of the relative work stations.

Thus, Claims from 1 to 3 refer to that more simplified solution, and therefore are formulated to also include that one; obviously, the ideal and normal configuration of the hand packaging work table is described in the subsequent claims.

With reference to FIG. 2, a hand packaging work table for the manual packaging of crates with fruit and vegetable products comprises generally:

- a support structure 1 of elongate shape supported on a plane;
- a first mobile conveyor 2 (fruit storage conveyor);
  - whose upper mobile surface 3 is arranged on a horizontal plane;
  - has a flat substantially elongate upper surface;
  - travels in a closed-loop path;
  - is supported by said structure and is suitable to support and transfer with a substantially horizontal and generally controllable movement the products 4 placed on it;
- a second mobile belt conveyor 5 (crate transfer conveyor), whose mobile upper surface 6 travels in the same direction and has a flat substantially elongate upper surface, is supported by said structure, and is suitable to move a plurality of crates 7.

According to the invention, said hand packaging work table is fabricated with the following characteristics, which can also be realized separately from each other:

a single, common return conveyor 8 is provided, wherein are transferred, with means that will be better explained later, those products that it was not yet possible to transfer and place in the respective crates, and that are brought back to the front of the fruit storage conveyor, by known manners;

and a single common conveyor 70 is also provided, which for convenience of description will herein be referred to as "conveyor for products selected in other ways" arranged above said crate transfer conveyor 5, by which the operators eliminate those products that the operators do not wish, for any reason, to include in the crates being packaged.

Also, the upper surfaces 3, 6 of said two mobile conveyors 2, 5 are arranged on parallel horizontal planes, and are arranged at a predefined and constant height difference (h).

This simple first embodiment, in order to be suitably optimized, must be accompanied by a suitable downsizing of the width of the two conveyors 2 and 5, and of the return conveyor 8, however such downsizing is easily determined by a person skilled in the art on the basis of other constructive requirements, and naturally of the preferences of the operators assigned to carrying out the work on the hand packaging work table.

It can be observed in particular that the return path of the products not placed in the respective crate include here a single return conveyor 8, which moves substantially on the same horizontal plane of the first conveyor 2. Said conveyors 2 and 8 travel in opposite directions, so as to enable the products that are not packaged and therefore arrive to the end of the travel on the conveyor 2 to return to the head of the conveyor on the return travel on the return conveyor 8.

It should also be pointed out that, in order for this operation to be carried out without hindrances, the return conveyor 8 must be arranged on the same horizontal plane as the respective first conveyor 2 (product storage conveyor).

In these conditions, it also becomes particularly advantageous if said return conveyor 8 is positioned entirely below the second conveyor 5, the crate transfer conveyor. In fact, if the two conveyors 2 and 5 must be, for ergonomic reasons, as near as possible to the body of the operators, the position of the return conveyor 8, which must be near the conveyor 2, will be below said second conveyor (crate transfer conveyor).

A conveyor will now be described in its most complete embodiment. With reference to the figures, on the hand packaging work table described above is added a third mobile conveyor 10, having substantially the same characteristics of said first conveyor 2, arranged, with respect to a vertical plane "m" substantially median to the upper sliding surface of said return conveyor 8, in a position opposite and preferably symmetrical to said first conveyor 2.

This third conveyor 10 is also oriented like said first conveyor 2, and is driven in a motion parallel to the same.

In addition, said return conveyor 8 is made suitable to also transfer the products coming from said third conveyor 10, and therefore it is adjacent to the latter.

To enable said return conveyor 8 to receive the products that are still present at the end of the two conveyors 2 and 10 (product storage conveyors), first deflecting means 20 are arranged above said first and third conveyor 2, 10 in the respective end zone, and suitable to deflect the products still present on these conveyors toward and onto said common return conveyor (8).

Such means can be realized in various manners, for example by means of flaps, mobile walls, also with curved and/or variably inclinable paths; advantageously, said deflecting means are also made active or removable to suit operating requirements.

Similarly, second deflecting means 21 are provided arranged above and at the end of the travel of the return conveyor, and suitable to move the objects carried by said return conveyor 8 toward and above said first and third conveyor 2, 10, in completely similar manners.

Said first and second deflecting means 20, 21 make it possible for the products to be carried on said conveyors 2 and 10, and then transferred onto said return conveyor 8, and then again to the conveyors 2, 10, in a closed path continuously in motion, until the moment when they are transferred manually to the respective crate.

Figure 3:
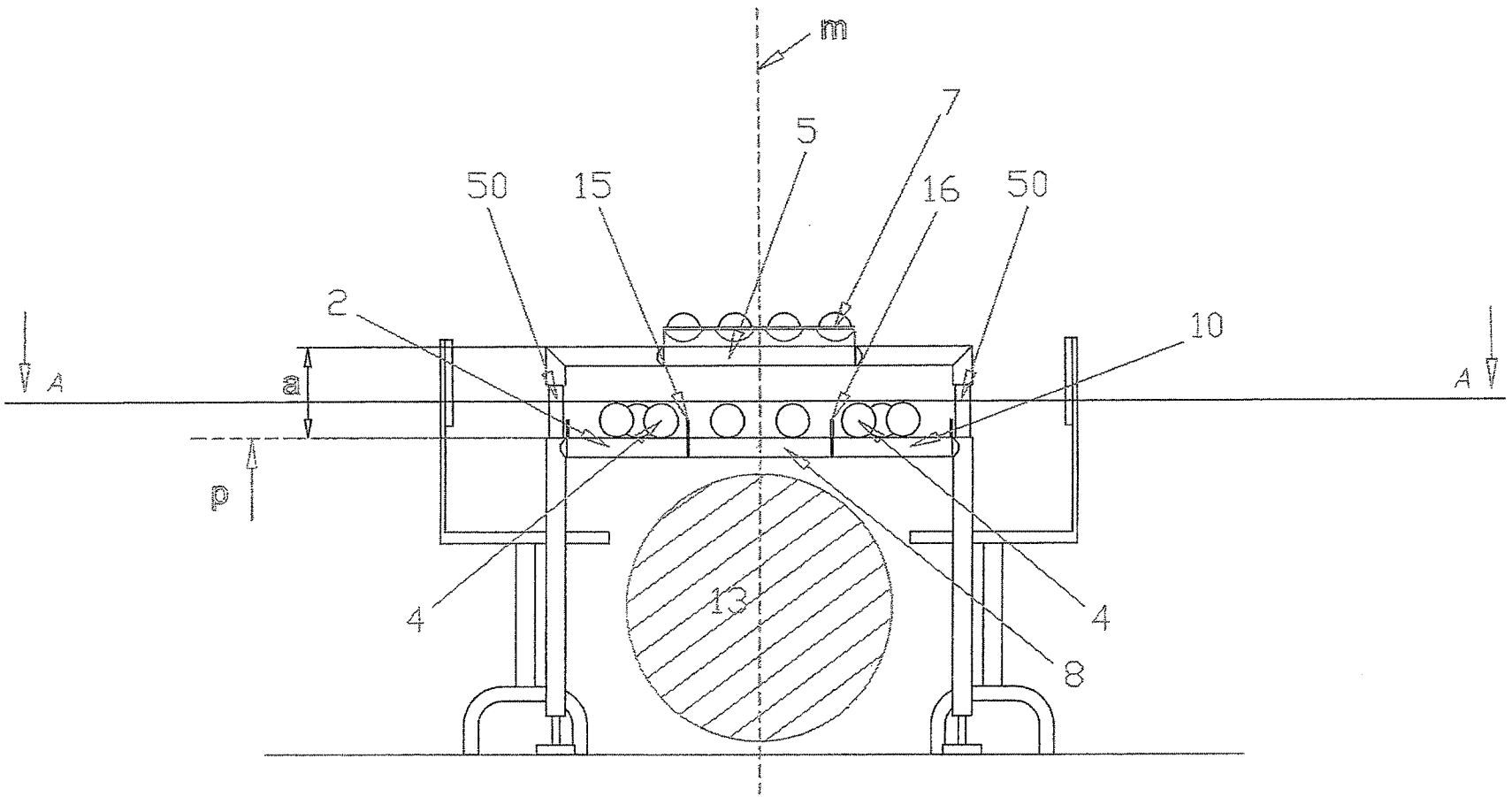
FIG. 3 is a view completely identical to FIG. 2, but in which further details of the invention are shown.
Figure 4:
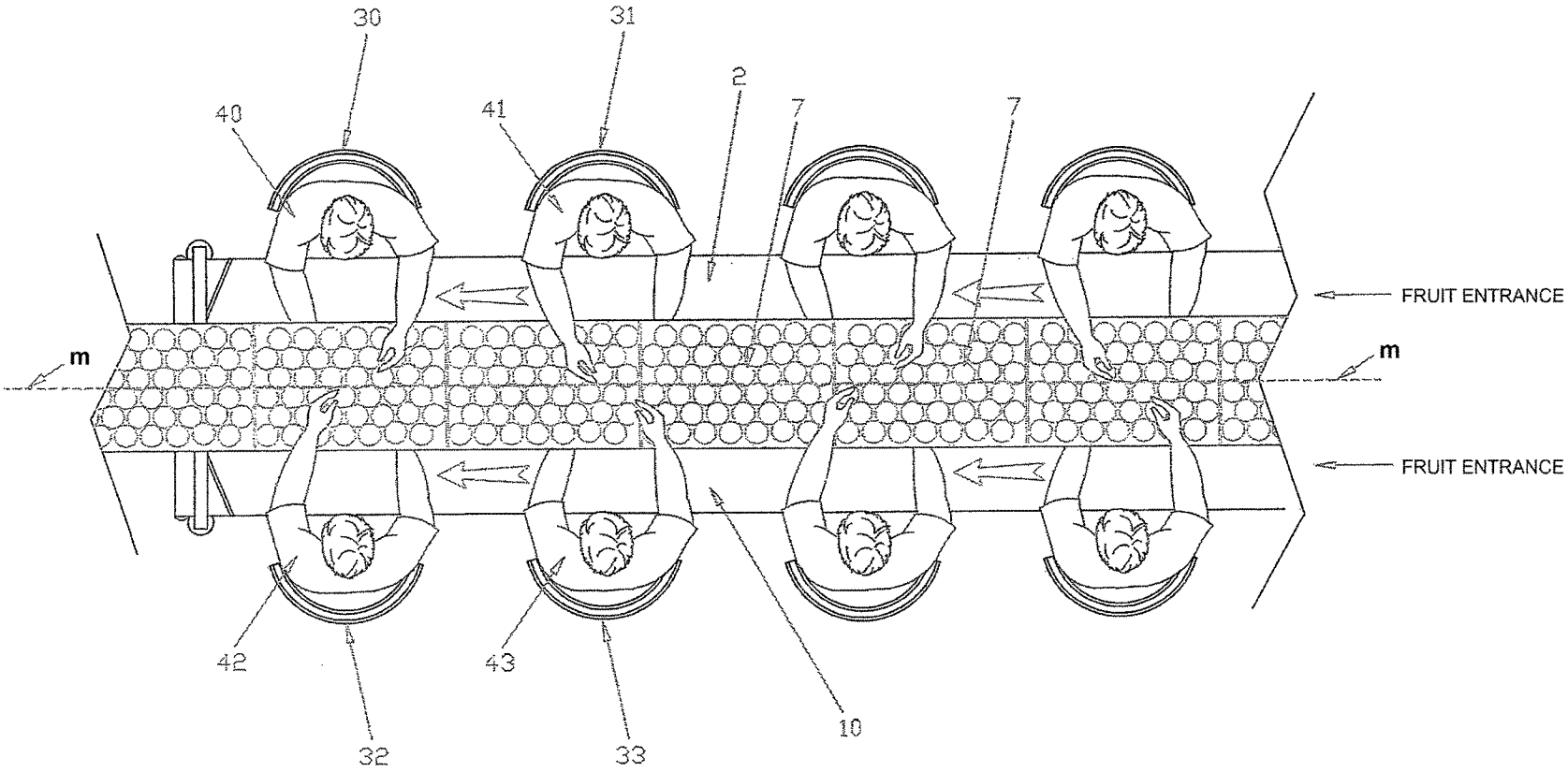
FIG. 4 shows a plane view from above of the hand packaging work table of FIG. 2, illustrated in symbolic form.

With reference to FIG. 3, the separation in height (a) of the second crate conveyor 5 with respect to the level "p" of said first conveyor 2 and/or of said third conveyor 10 is usefully made adjustable preferably by means of the variation in height of said second conveyor 5 through suitable adjusting and control devices 50 shown here as a telescopic adjustment of the vertical support uprights of the second conveyor 5.

In addition, said hand packaging work table is accompanied by appropriate seats 30, 31, 32, 33, . . . arranged externally to said first and/or third conveyor 2, 10 and aligned with them, wherein said seats are adjustable in height.

Finally, below said first and third conveyor the structure of the hand packaging work table is built in such a way as to obtain an empty space 13 suitable to be used to insert the folded legs of the operators 40, 41, 42, 43, . . . seated on said seats 30, 31, 32, 33, . . . .

It will now be appreciated that the concurrent possibility of adjusting the height of the second conveyor 5 and the possibility of adjusting the height of said seats 30, 31, 32, 33, . . . , as well as the possibility for the operators of inserting their legs under the hand packaging work table, allows the operators to maintain extremely more comfortable and natural postures, and satisfies on the whole the requirements of the previously mentioned new regulations in this regard.

Figure 5:
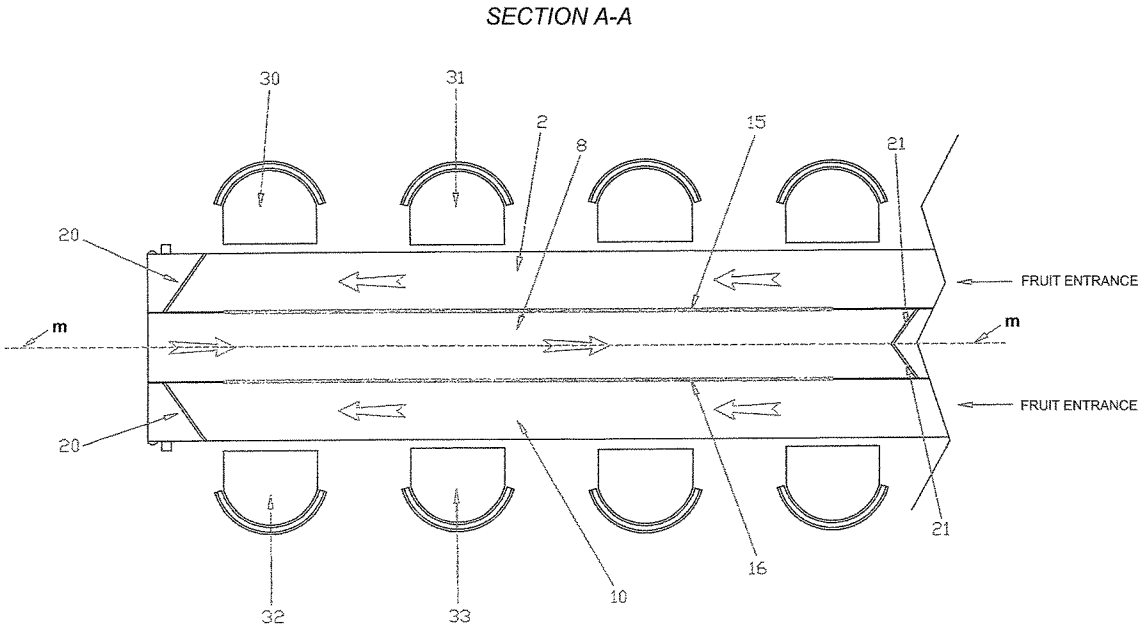
FIG. 5 illustrates a plane view from above along cross section A-A of FIG. 3.

With reference to FIGS. 3 and 5, in order to prevent the products carried by said return conveyor 8 from moving in an uncontrolled manner toward one or the other of said first or third product conveyor 2 and 10, and vice versa, before having arrived at the respective stops and being deflected by the respective means 20, 21, respective separation devices are installed in such a manner as they can naturally be easily removed, and can substantially separate said return conveyor 8 from the two adjacent conveyors 2, 10; as exemplified, said separating devices can be simply activated by means of respective barriers 15, 16 arranged "flush" with the same conveyors.

Figure 6:
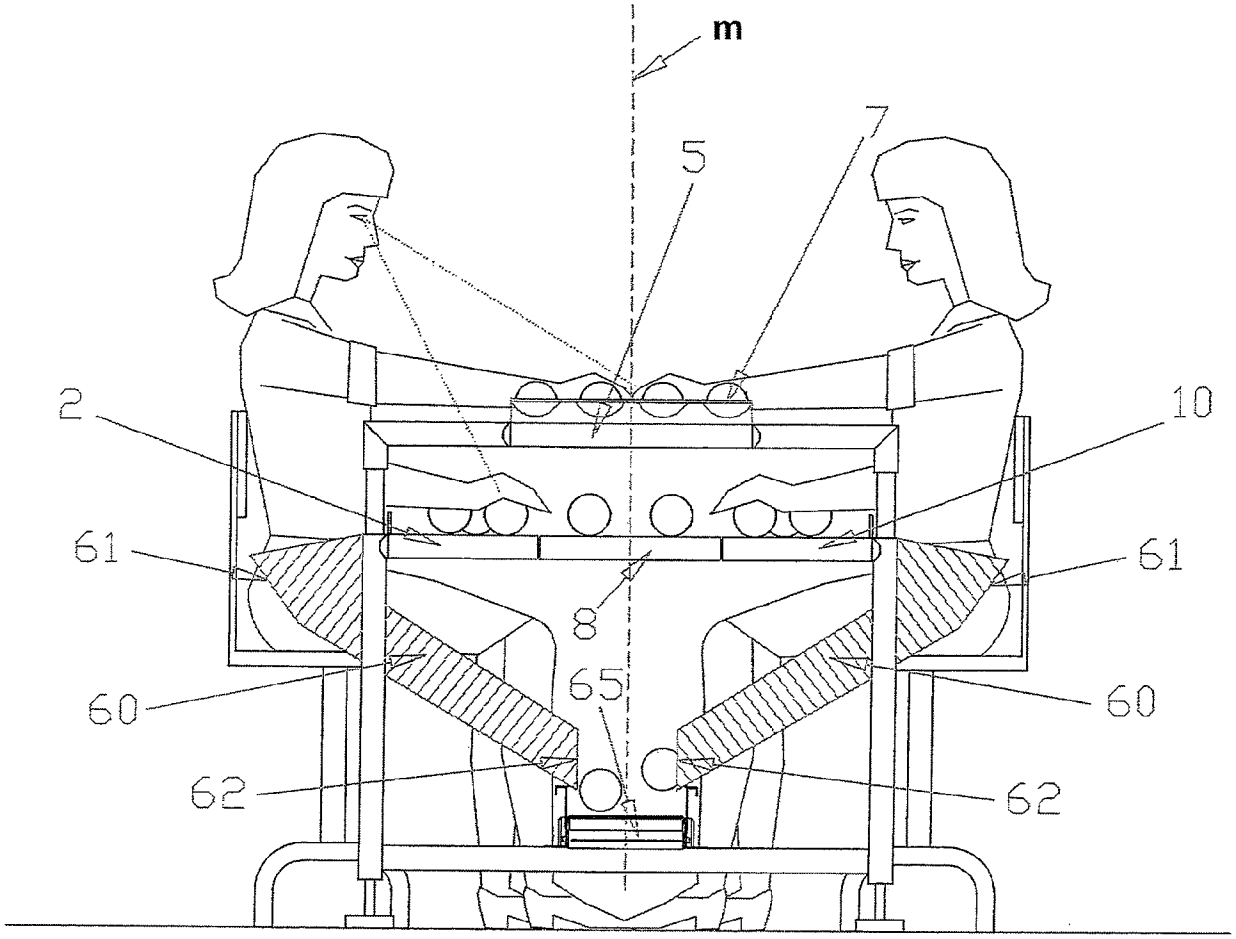
FIG. 6 is a view similar to FIG. 2, but with further details of the hand packaging work table according to the invention.

With reference to FIG. 6, the alternative form of the embodiment of the so-called "rejected product conveyor" will now be briefly described.

According to such alternative, a rejected products conveyor 65 is built and installed in a position below said first and third conveyor so as not to take up any space above; in this manner, the radical reduction in the width of the hand packaging work table, as previously indicated, is maintained.

Preferably, said conveyor 65 for rejected products is located in a central position, and below said return conveyor 8.

For the further purpose of transferring in a simple, immediate and ergonomic manner the discarded products singled out by said operators, at least one guide 60 is arranged, in a manner suitable to convey the products leaving the hands of the operators toward said rejected product conveyor 65.

As shown in FIG. 6, said guides 60:

are installed in a substantially inclined orientation;

are provided at the respective upper ends with a feeding mouth 61;

are provided at their lower end with respective discharge mouths 62, naturally arranged above said rejected product conveyor 65.

It is also necessary to consider the possibility that the products transferred from said product storage conveyor should be briefly examined by the operators before being placed in the relative crates, and that those products that are not considered homogeneous with the quality to be packaged should be in turn separated in two different classes:

products that are of clearly inferior quality that should be sent to less prized processes, such as for example in the production of jams;

or products of lesser quality, but still acceptable for sale as single fresh products, but with a different quality rating.

In these circumstances, that is, considering both of said sub-classes, it can be advantageously foreseen that the configuration of the hand packaging work table of FIG. 2 should be substantially integrated with the configuration of the hand packaging work table of FIG. 6; in other words, both the above-mentioned "rejected product conveyor" and "conveyor for products selected in other ways", indicated by numbers 65 and 70 should be provided, and not only one of them.

In fact, from both the construction and the operating point of view there is no obstacle or logical impediment to realize and install on the same hand packaging work table both of said conveyors indicated by numbers 65 and 70, nor naturally to using both at the same time, or one or the other individually, as it may be convenient.

From the enclosed figures, and from the description, it will be easily appreciated that, for construction and functional reasons, said hand packaging work table should be substantially symmetrical with respect to said vertical plane "m" substantially median to the upper sliding surface of the return conveyor 8.

The invention claimed is:

1. A hand packaging work table for manual packaging of crates, particularly with fruit and vegetable products, comprising:

a support structure supported on a plane;

a first mobile conveyor belt supported by said support structure and having an elongate upper mobile surface arranged on a horizontal plane;

said first mobile conveyor traveling in a first direction and being configured to support and transfer the products placed on it;

a second mobile belt conveyor supported by said support structure and having an upper mobile surface that moves in the same first direction, said second mobile belt conveyor being configured to move a plurality of crates; and a return conveyor for products carried by said first conveyor that are not packaged, wherein:

the upper surfaces of said first and second mobile conveyors are arranged on parallel horizontal planes and are arranged at a pre-defined and constant difference in height.

2. A hand packaging work table according to claim 1, wherein said return conveyor moves substantially on the same horizontal plane as said first conveyor, and which travels in an opposite direction to said first conveyor.

3. A hand packaging work table according to claim 2, wherein said return conveyor is arranged completely below said second conveyor.

4. A hand packaging work table according to claim 3, further comprising a third mobile conveyor substantially the same as said first conveyor, said third conveyor being arranged, with respect to said return conveyor, in a position opposite to said first conveyor and travelling in said first direction parallel to said first conveyor.

5. A hand packaging work table according to claim 2, wherein said return conveyor also carries products carried by a third conveyor, further comprising first deflectors arranged above said first and third conveyors to deflect products carried by said first and third conveyors toward and onto said return conveyor.

6. A hand packaging work table according to claim 5, further comprising a second deflector arranged above said return conveyor to deflect products carried by said return conveyor toward and onto said first and third conveyors.

7. A hand packaging work table according to claim 6, wherein at least one of said first and second deflectors are configured to be selectively activated.

8. A hand packaging work table according to claim 2, further comprising a third mobile conveyor substantially the same as said first conveyor, said third conveyor being arranged, with respect to said return conveyor, in a position opposite to said first conveyor and travelling in said first direction parallel to said first conveyor.

9. A hand packaging work table according to claim 1, further comprising a third mobile conveyor substantially the same as said first conveyor, said third conveyor being arranged, with respect to said return conveyor, in a position opposite to said first conveyor and traveling in said first direction parallel to said first conveyor.

10. A hand packaging work table according to claim 9, further including at least one operator support arranged externally to each of said first and third conveyors and aligned with said first and third conveyors, respectively, said supports being adjustable in height.

11. A hand packaging work table according to claim 10, further comprising an empty space below said first and third conveyors, said empty space being suitable for accommodating the legs of operators seated on said supports.

12. A hand packaging work table according to claim 9, wherein:

said return conveyor for products not packaged moves substantially on the same horizontal plane as said first and third conveyors, and which travels in an opposite direction to said first and third conveyors, and separation devices are positioned between said first conveyor and said return conveyor, and between said third conveyor and the return conveyor to prevent products carried by said return conveyor from moving toward said first or third conveyor, and to prevent products carried by said first and third conveyors from moving toward said return conveyor.

13. A hand packaging work table according to claim 9, wherein said work table is substantially symmetrical with respect to a vertical plane substantially median to said return conveyor.

14. A hand packaging work table according to claim 9, further comprising a rejected products conveyor which is arranged in a position lower than said first and third conveyors.

15. A hand and packaging work table according to claim 1, wherein the height of said second conveyor is adjustable to vary the separation in height of the second conveyor with respect to the level of said first conveyor.

16. A hand packaging work table according to claim 1, further comprising a rejected products conveyor which is arranged in a position lower than said first conveyor.

17. A hand packaging work table according to claim 16, further comprising at least one guide for rejected products, wherein such guide is installed in a substantially inclined orientation and is provided at its upper end with a feeding mouth and is provided at its lower end with a discharge mouth positioned above said rejected product conveyor.

18. A hand packaging work table according to claim 1, further comprising a rejected products conveyor arranged in a position above said return conveyor.

* * * * *